US006883441B2

(12) United States Patent
Barr

(10) Patent No.: US 6,883,441 B2
(45) Date of Patent: Apr. 26, 2005

(54) INCINERATOR ROOM FOR QUICK DESTRUCTION OF SENSITIVE DOCUMENTS

(76) Inventor: Charles R. Barr, 2885 Whipporwill Dr., Morgan Hill, CA (US) 95037

( * ) Notice: Subject to any disclaimer, the term of this patent is extended or adjusted under 35 U.S.C. 154(b) by 0 days.

(21) Appl. No.: 10/446,533

(22) Filed: Sep. 10, 2003

(65) Prior Publication Data

US 2005/0051064 A1 Mar. 10, 2005

(51) Int. Cl.[7] ..... F23G 5/00; F23N 5/24; E05G 1/00

(52) U.S. Cl. ..... 110/235; 110/193; 109/29

(58) Field of Search ..... 110/193, 194, 110/348; 109/29, 24, 23, 31; 126/52 B; 431/91, 6; 434/226

(56) References Cited

U.S. PATENT DOCUMENTS 2,497,939 A * 2/1950 Garraway et al. ..... 431/6
3,730,111 A * 5/1973 Matthews ..... 109/29
3,797,412 A * 3/1974 DiPaola et al. ..... 109/29
4,141,373 A * 2/1979 Kartanson et al. ..... 75/403
4,181,081 A * 1/1980 Weber ..... 110/212
4,253,406 A * 3/1981 Spitz et al. ..... 110/241
4,287,079 A * 9/1981 Robinson ..... 510/105
4,303,396 A * 12/1981 Swiatosz ..... 434/226
4,495,873 A * 1/1985 Blankenship ..... 110/250
4,515,091 A * 5/1985 Schlueter ..... 110/346
4,526,548 A * 7/1985 Livingston ..... 434/226
5,203,707 A * 4/1993 Musto et al. ..... 434/226
5,700,142 A * 12/1997 Miller et al. ..... 431/125
6,179,620 B1 * 1/2001 Schmid ..... 434/226

* cited by examiner

*Primary Examiner*—Kenneth Rinehart
(74) *Attorney, Agent, or Firm*—Ronald C. Fish, A Law Corporation

(57) ABSTRACT

An incinerator room to store secret documents and destroy them automatically according to a burn sequence by spraying slow burning flammable liquid on the contents of said room from one or more reservoirs. A control circuit, preferably supplied with energy from a secure source such as a battery, controls the ignition sequence to spray the flammable liquid, then start ignition means and start an exhaust fan and open optional electrically operated shutters or flue. The electrically operated flue prevents unauthorized access to the room by humans or fiber optic spying apparatus via ingress through the chimney of the exhaust system. Pressurized reservoirs and electrically operated valves are used in the preferred embodiment.

19 Claims, 6 Drawing Sheets

INNER-OUTER WALL EMBODIMENT

INNER-OUTER WALL EMBODIMENT

INCINERATOR ROOM CONTROL SEQUENCE TO DESTROY DOCS

INCINERATOR ROOM FOR QUICK DESTRUCTION OF SENSITIVE DOCUMENTS

BACKGROUND OF THE INVENTION

The increasing unrest in the world has lead to occasions where embassies were stormed, countries were invaded and other instances when the security of secret documents was put into jeopardy. Typically, sensitive documents are stored in various rooms and file cabinets spread throughout an embassy, ship, corporate headquarters, base, etc. When a contingency which threatens the security of the documents arises, the documents have to be gathered and destroyed. Shredding is not an instantaneous process, nor is burning, so this entire process can take more time than is available to ensure the complete destruction of the documents.

Document safes and locking filing cabinets are no answer since the documents still exist, and the containment can be breached and the documents read. Furthermore, document safes and filing cabinets are small in volume, and the number of sensitive documents can exceed the capacity to store them in these types of devices.

The incinerator prior art includes U.S. Pat. Nos.: 4,141,373; 4,181,081; 4,253,406; 4,287,079; 4,495,873 and 4,515,091. None of these deal with incinerator rooms inside other buildings.

This has led to a need for a document destruction system where all sensitive documents can be stored, which has plenty of room and which the documents can be incinerated in a short time with a single, preferably non electrical command.

SUMMARY OF THE INVENTION

The genus of the invention is defined by the following characteristics which all species in the genus will share. First, there will be one or more walls, a floor and a ceiling which define an enclosed space. The walls could be one cylindrical, oval or other shaped single wall which has one end which joins with the other end thereof to form any enclosed perimeter. The floor and ceiling join with the one or more walls to form an enclosed room. At least one of the walls, floor or ceiling must have a door or other access port therein which can be closed to contain the fire. Next, if the walls, floor, and ceiling themselves are not fireproof, there must be fireproof material lining the inner surfaces of said one or more walls, ceiling and floor which has sufficient insulating properties to prevent said one or more walls, floor and ceiling from igniting when a fire is lit in said room. Hereafter, the side lined with the fireproof material will be called the hot side and the opposite side of the wall, floor or ceiling away from the fire will be called the cold side. Next, there is required at least one reservoir of slow burning, flammable liquid. Preferably, this reservoir or all reservoirs are located on the cold side. Next, there is required at least one nozzle for spraying slow burning, flammable liquid on confidential documents and other items stored in said room. Next, there is required at least one valve that couples the reservoir(s) to the nozzle(s) and which can be controlled to turn on or turn off flow of flammable liquid to said nozzle(s). The valve can be electrically or mechanically operated, and if there is more than one valve, they can be operated simultaneously or sequentially to open and allow spraying of the flammable liquid to coat the contents of the room. In some embodiments, there is an exhaust fan coupled to a chimney to remove combustion gases from the inner room, but in other embodiments, a simple chimney without an exhaust fan is used. The chimney or exhaust fan should have lockable shutters to prevent unauthorized entry into the room, but this security could be provided by making the exhaust passageway too small for human entry and making it serpentine or with one way valves to prevent unauthorized ingress by fiber optic spying equipment. Finally, a control circuit coupled to the valves, ignition apparatus and exhaust fan to control them to open the valves, cause pumping of the flammable liquid if pressurized reservoirs are not used, start the ignition apparatus after the contents of the room are soaked and start the exhaust fan. In the claims, the term control means includes one or more pumps if the reservoirs are not pressurized.

BRIEF OF THE DRAWINGS

DETAILED DESCRIPTION OF THE PREFERRED AND ALTERNATIVE EMBODIMENTS

Figure 1:
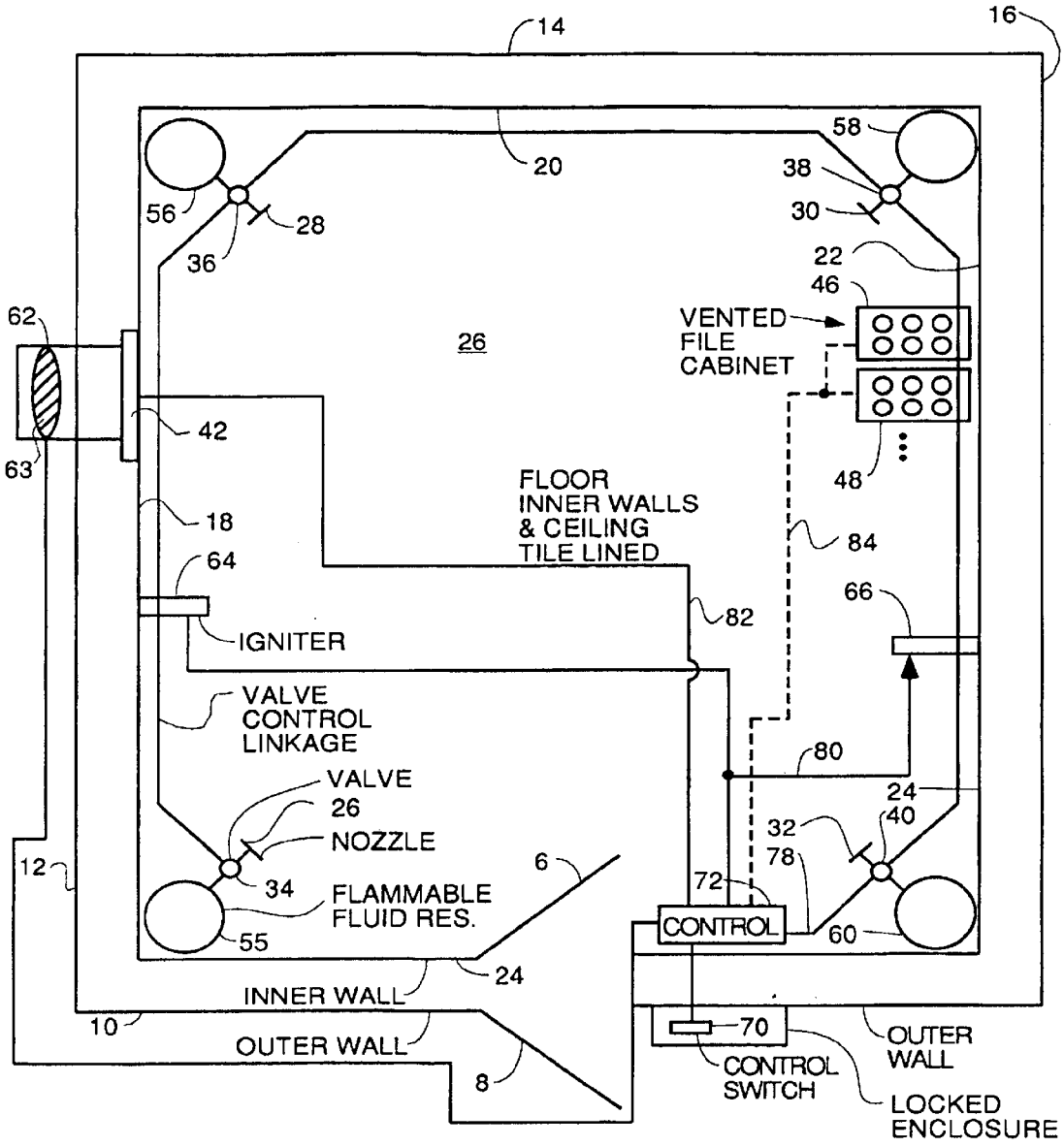
FIG. 1 is a top view looking down into an incinerator room according to the invention in a first embodiment where walls, floor and ceiling parallel to existing structures are used.

Referring to FIG. 1, there is shown a diagram of the preferred embodiment. FIG. 1 is a top down view of a room having outer walls, ceiling and floor with parallel inner fireproof walls, floor and ceiling in which documents to be destroyed can be stored. This embodiment is preferred because it can be used to convert an already existing room into an incinerator room. The room has outer walls 10, 12, 14 and 16 and has inner walls 18, 20, 22, 24 and the ceiling and floor 26. The outer room floor is not visible but is parallel to and beneath the inner room floor 26. Neither the ceiling of the outer room nor the ceiling of the inner room is visible. The outer walls can be conventional wood or drywall walls so long as adequate insulation is applied to the inner walls to prevent enough heat from reaching the outer walls to ignite them. A door 6 in the inner wall can be closed and locked, and has insulating ceramic tiles lining the inner surface thereof. A door 8 in the outer wall can also be closed and preferably locked to provide additional security.

Typically, the inner walls, ceiling and floor that are built in parallel with the outer walls, ceiling, floor of an existing room. The inner walls are lined with a fireproof, preferably insulating material such as ceramic tile. The inner wall could be metal, wood, fiberboard, drywall over wood frame, etc. depending upon the heat transfer characteristics of the tile lining the inner wall. Paper burns at 451 degrees F., so the tile or other fireproof material must have insulation properties and thickness sufficient to prevent the temperature of the inner wall material from reaching its combustion temperature over the duration of the fire. In some embodiments, temperature sensors in the inner wall can be coupled to a sprinkler system in the combustion chamber to set it off if the temperature of the material of the inner wall gets close to the combustion temperature. In some embodiments, the inner wall may be lined with two different materials such as a ceramic tile to face the fire over a fireproof or fire-resistant material over the material of the inner wall. In the preferred embodiment, the inner walls are an aluminum frame that parallels the four walls, ceiling and floor. Ceramic tiles are attached to the aluminum frame. Typically, the measurements of the room will be taken and then the aluminum frame will be built elsewhere and brought back to the site and assembled. The tiles will be glued together at the joints by some adhesive such as silcone adhesive or other glue such as aluminum epoxy which can take the heat.

Figure 2:
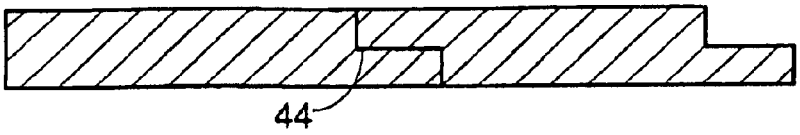
FIG. 2 is diagram of the preferred joint type for the ceramic tiles lining the inner wall.

FIG. 2 is a diagram of the preferred joint for the ceramic tile embodiments showing on overlapping joint configuration at 44 to help minimize the heat leakage path.

The room is plumbed with nozzles 26, 28, 30 and 32 for spraying a flammable liquid on the contents of the room. The flammable liquid is preferably a slow burning liquid such as charcoal lighter so as to prevent the room from exploding or the fire from getting so hot as to exceed the temperature the walls can withstand. The nozzles are coupled via conduits or pipes and valves 34, 36, 38 and 40 to one or more reservoirs of the flammable liquid. The nozzles preferably create a fine mist of the slow burning flammable liquid that covers everything in the room. To prevent explosions, the nozzles preferably do not spray any further flammable liquid after the fire is started.

In some embodiments, the valves are solenoid operated valves that coupled together by a wire 78 that is energized by a control circuit to be described below so that they all open simultaneously or sequentially. Since the loss of electrical power from utilities may occur, the control system is typically battery operated. However, in some embodiments, multiple cycles of burning are implemented, so it is preferred that the values be mechanical and that mechanical pushrods to open the valves be used so that the flames from a burn cycle do not destroy wires in the room and disable the ability to open the valves for subsequent cycles.

In some embodiments, the wires coupling the control system to the various components that are controlled such as wire 78 can be fireproof and/or located on the cool side of inner wall 18. Although the wire 78 is shown in FIG. 1 inside the inner wall 18, that is only for clarity in the drawing because of the small amount of space between the inner and outer wall. In reality, the pressurized reservoirs, solenoid operated values and control wiring to all controlled devices will be located on the cool side of the inner wall so that only the nozzles and igniters extend through the inner wall and into the combustion chamber.

Spaced around the room at regular or irregular intervals are battery operated electric ignition igniters of which 64 and 66 are typical. These function to generate sparks or open flames which will start the flammable liquid on fire.

Figure 3:
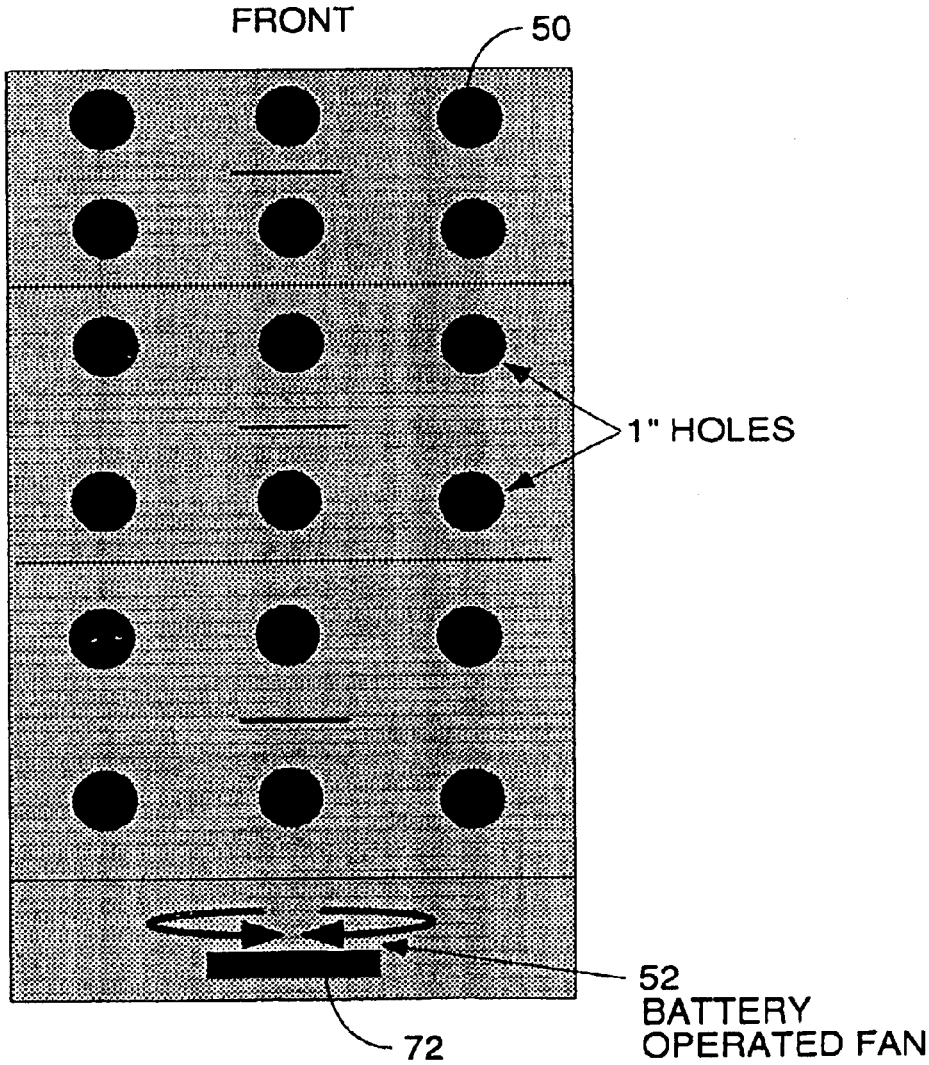
FIGS. 3 and 4 are front and side views respectively of a vented file cabinet with a built in fan.
Figure 4:
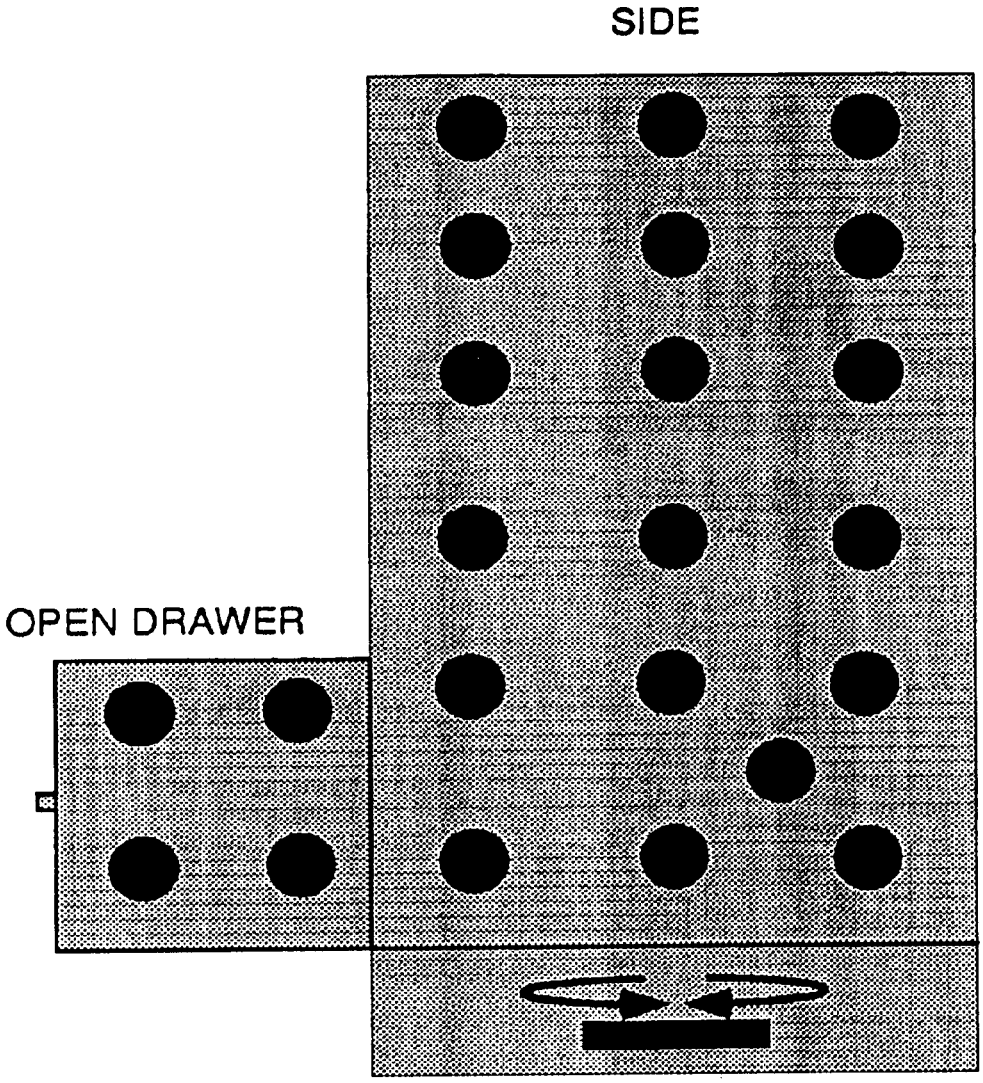

Confidential documents can be stored in piles on the floor, on wooden shelves or stored in flammable filing cabinets. Confidential servers can also be stored in the room and their cabinets drilled with holes like the holes in the filing cabinets so that the flammable liquid will reach the internal circuitry and hard disk of the server. In the preferred embodiment, the confidential documents are stored in vented, wood filing cabinets of which cabinets 46 and 48 are typical. FIGS. 3 and 4 are front and side views respectively of a vented file cabinet with a built in fan. The advantage of filing cabinets with built in fans is that they can be moved around and as many of them as are needed to house the volume of documents to be secured may be used and they may be moved around without rendering obsolete the positions of fans in the floor of the inner wall room which were designed to be located under filing cabinets so as to hasten the burning of the contents thereof.

The filing cabinets have holes 50 in the front, top, sides and bottom. The holes allow flammable liquid to seep in and soak the papers stored therein and to allow a drafts of air to enter and exit the front, top sides and bottom to speed the burning of the contents of the filing cabinet. Preferably, one inch diameter holes are used.

In the preferred embodiment, each filing cabinet has a built in, battery operated fan positioned above a vented bottom which begins to blow air up through the filing cabinet when the filing cabinet is to be burned. In other embodiments, the fan can be powered by utility power. This fan is turned on when the signal to turn on the spraying of flammable liquid is given or it turns on automatically when sensors detect a significant rise in temperature of the room such as would be caused by combusion or when a sensor detects the spraying of the flammable liquid. The battery and fan control module are shown at 54 in FIG. 3.

The reservoirs of flammable liquid are shown at 55, 56, 58 and 60. Each reservoir is pressurized in the preferred embodiment and has the form of a propane bottle such as is commonly used in gas barbeques. However, in other embodiments, electrical pumping of the flammable liquid to the nozzles can be used so pressurized reservoirs are not necessary. Pressurization is preferred because in some instances, invaders may cut the electrical power so utility system powered pumps would not work. Where electrical pumps are used, battery powered pumps may be used in some embodiments but utility system power may be used in other less secure embodiments.

The room has a battery powered (or utility system powered in some embodiments) exhaust fan 42 to blow combustion products out to the atmosphere. A duct and chimney assembly is shown at 62 to conduct the combustion products out of the outer walls to the atmosphere. An electrically operated shutter 63 in the chimney the opening and closing of which is controlled by control system 72 via control signals on line 65 is closed when the room is not burning and opened when the ignition sequence starts.

A control system 72 coupled to a control switch 70 controls spraying of the flammable liquid from the nozzles, sparking by the ignition units and operation of the exhaust fan. The control system is coupled to solenoid operated valves 40, 38, 36 and 34 by conductor 78 which is coupled to the control ports of all the solenoid operated valves. The control system 72 is also coupled to the ignition units 64 and 66 by line 80, and is coupled to the exhaust fan 42 via line 82. The control system controls the solenoid operated valves to open for a predetermined time after control switch 70 is pressed and then shuts them off to terminate spraying of the flammable liquid. Then, the control system causes the igniters to start flaming or generating sparks to start the fire, and turns on the exhaust fan. In some embodiments, the control system is also coupled to the fans in the filing cabinets also to start them after or as the igniters are signalled to start the fire, as symbolized by dashed line 84. More details of the control system are given in FIG. 5.

In other embodiments, an entirely separate room with metal walls or walls protected by ceramic tiles or other fireproof materials may be used. In these single wall embodiments, the walls can be made of metal and not lined with ceramic material or lined with ceramic tiles to keep the outside temperature of the wall below a level which could injure somebody who touched it.

Figure 5:
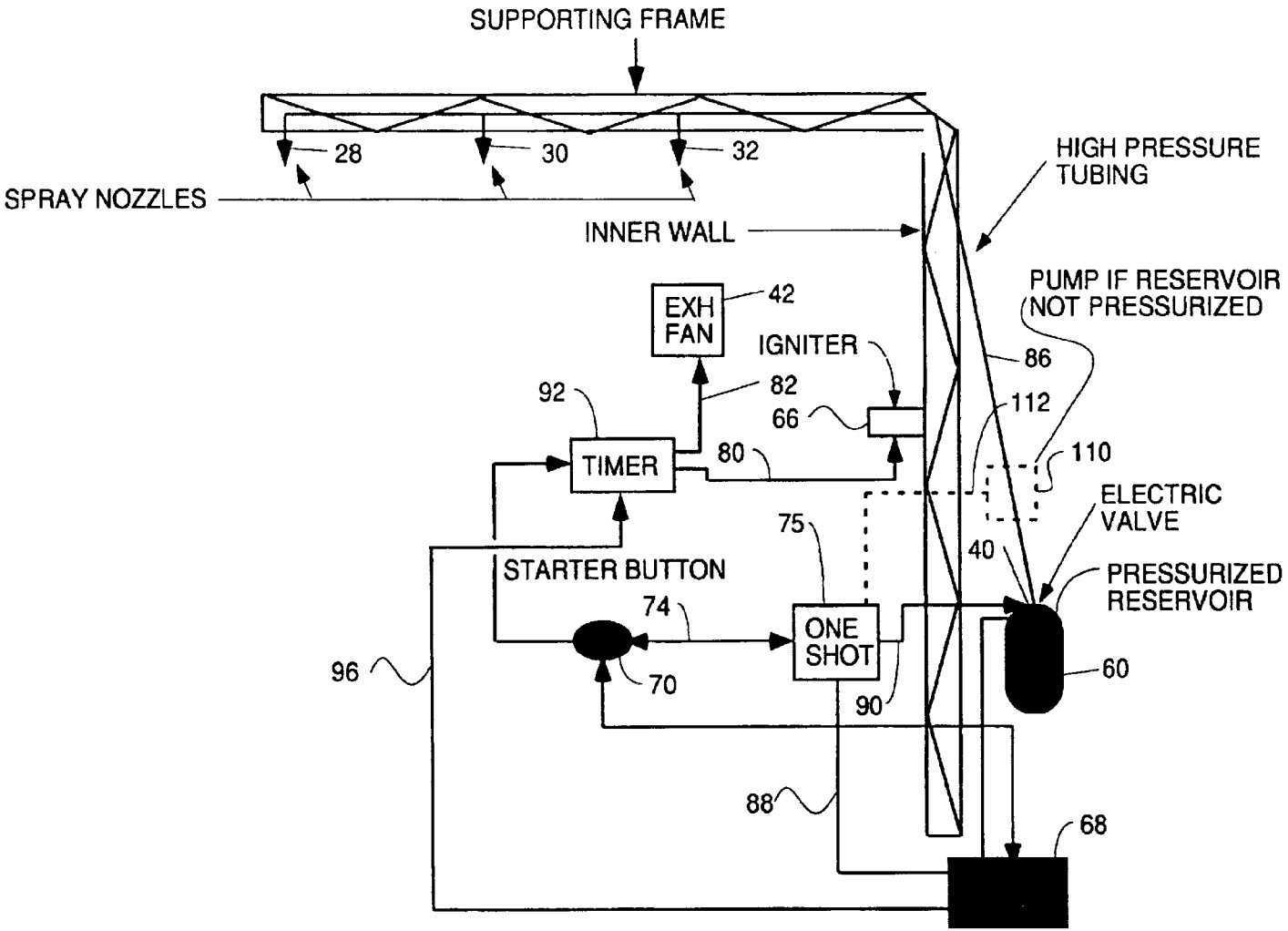
FIG. 5 is more detailed diagram of the control system.

FIG. 5 is a diagram of a simple control system to control the spraying of the flammable liquid and the ignition units. A battery 68 is coupled to a starter switch 70 to supply power thereto. In less secure embodiments, the battery 68 is eliminated and utility power is substituted or a portable gas powered electric generator or other suitable secure energy source can be substituted. The starter switch is coupled to the trigger input of a monostable multivibrator (one shot) 75 via line 74. The one shot serves to generate an output pulse of a predetermined duration which will control how long the flammable liquid is sprayed from pressurized reservoir 60. Each reservoir has its pressurized fluid output coupled to a nozzle through a solenoid operated valve (SOV). In the embodiment of FIG. 1, four separate pressurized reservoirs 60, 58, 56 and 54 are shown, each with its own SOV and valve. This is more expensive because of the duplication of functions and hardware needed to implement same. In the preferred embodiment of the control system shown in FIG. 5, only a single pressurized reservoir 60 coupled through a single SOV 40 is coupled via high pressure tubing 86 to all the nozzles. In embodiments, where the reservoirs are not pressurized, a pump 110 controlled by one shot 72 by supplying battery power on line 112 is during the one shot pulse is used to pump flammable liquid through the nozzles.

The one shot 72 typically drives a relay or other high power output stage which can couple battery power via line 88 to the power inputs of the SOVs via line 90. The SOVs remain open during the duration of the one shot pulse and then close. The duration of the pulse should be sufficient to allow enough flammable liquid to be stored to thoroughly soak all the papers in the filing cabinets and stored in piles.

The start button 70 is also coupled to a timer 92 which functions to delay the onset of power to the igniters for a delay sufficient to allow the nozzles to soak everything. The start switch is preferably locked inside a locked enclosure to which only one or a few trusted personnel have access. The timer starts a countdown clock when start button 70 is pushed, and then energizes line 94 thereby causing the ignition unit 66 to start generating sparks or flaming sufficiently to ignite the flammable liquid. The timer 92 is also coupled via line 94 to the exhaust fan 42 to energize it at the same time or shortly after energizing the igniters. Timer 92 receives its power to be supplied to the igniters and exhaust fan via line 96 from the battery 68. The start button should be locked in a secure cabinet or otherwise secured such as by using an electronic combination lock as the start switch so that only trusted personnel can start the ignition sequence.

Figure 6:
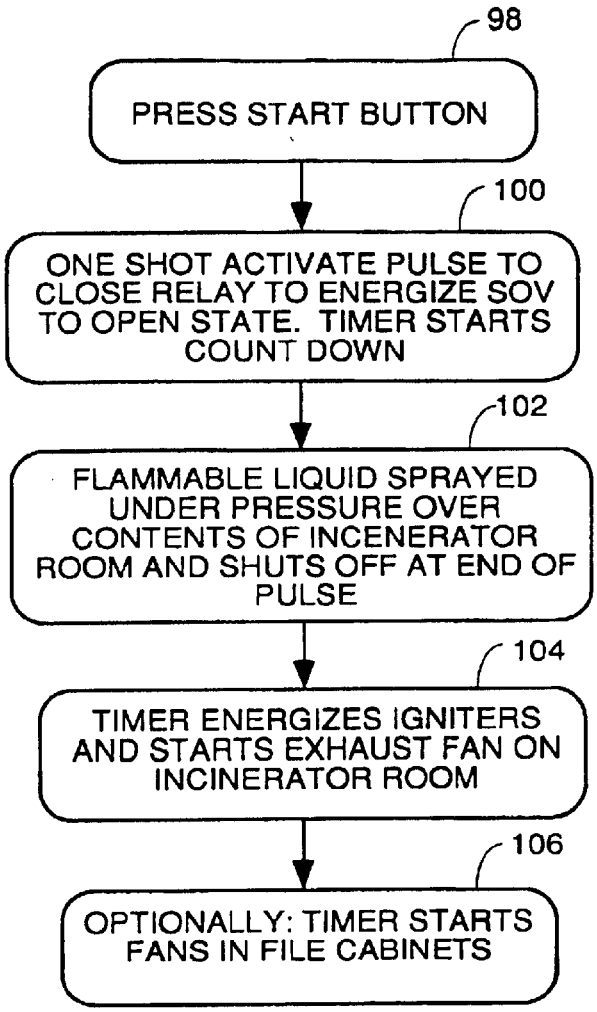
FIG. 6 is a flowchart of the sequence of events carried out by the control system to implement a document burn.

FIG. 6 is a sequence of events that are carried out in the preferred embodiment to burn the contents of the room. The initial manual steps are to evacuate all personnel from the incinerator room and close at least the inner door 6. Preferably, the outer door 8 will also be closed to prevent injury from anyone touching the inner door after the fire heats it up. Step 98 represents the initiation of the sequence by pressing the start button. This is done manually after the doors are dosed. Step 100 represents the activation of the one shot 72 in FIG. 5 when the start button is pushed. When the one shot is activated, it drives its output to logic one which causes a relay or other suitable high power switching device to close thereby connecting power from battery 68 via line 90 to the coil of a solenoid operated valve 40. This causes the valve to open and allows pressurized flammable liquid from reservoir 60 to enter tubing 86 and spray out the nozzles 28, 30 and 32. If more than one reservoir and SOV is used, line 90 is coupled to all the SOVs and they all simultaneously open and begin spraying, as represented by step 102. The one shot keeps its logic output at logic 1 for some predetermined interval that is set by the value of the capacitances selected for the circuit. These values may be adjustable in some embodiments to allow the time for spraying to be altered based upon the volume of contents in the room. It is important to get all contents well soaked before starting the igniters.

Step 104 represents the process of the timer 92 timing out and energizing the ignition devices and exhaust fan. The timer started a countdown when the start button was pushed. The countdown is designed to delay the start of the ignition devices until the process of soaking the contents of the room with flammable liquid is finished. Typically, the delay from stopping spraying to starting the ignition devices is 20 seconds or some other interval adequate to let any residual mist in the air of the inner room settle out. The idea is not to start the igniters when the air is filled with vapor or mist which might make it explosive. When the countdown reaches zero, the timer energizes line 80 in FIG. 5 with power from battery 68. This causes the igniters to start sparking or generating open flame in proximity to piles of documents soaked with flammable liquid so as to start the fire. The timer may also energize line 82 at the same time as it energizes line 80 so as to start the exhaust fan 42, or it may delay starting the exhaust fan till a short time after starting the fire.

Step 106 is optional. It represents the process of the timer energizing optional line 84 in FIG. 1 to start the fans in the filing cabinets blowing after the fire is started or simultaneously therewith.

Figure 7:
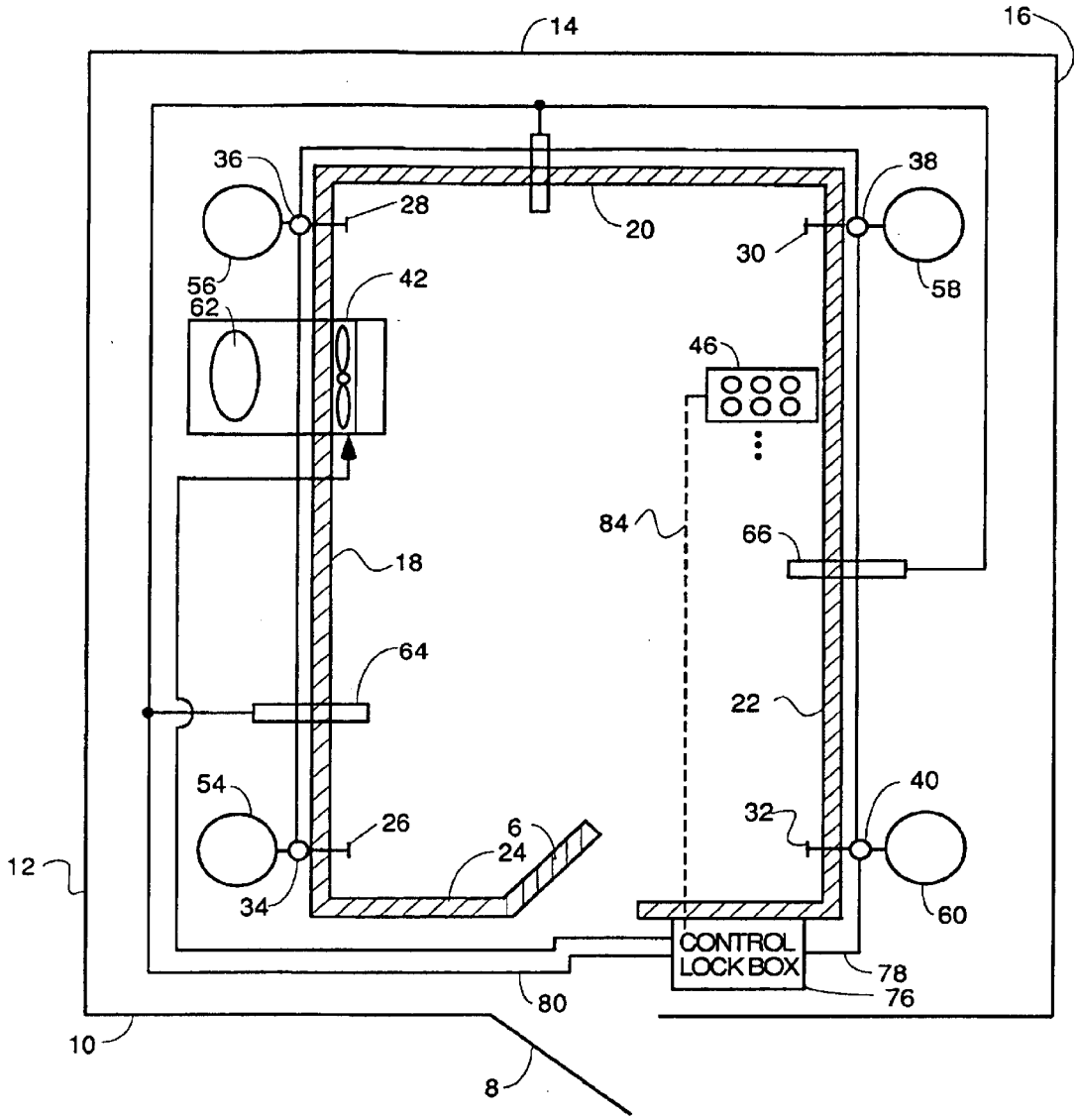
FIG. 7 is a drawing of the preferred embodiment with the reservoirs, solenoid operated valves, control box, and control wiring on the cool side of aluminum frame walls insulated by ceramic tiles.

FIG. 7 is a drawing of the preferred embodiment with the reservoirs, solenoid operated valves, control box, and control wiring on the cool side of aluminum frame walls insulated by ceramic tiles. The inner walls and ceramic tiles are indicated by the crosshatched area. All items having reference numbers the same as numbers in FIG. 1 represent the same components performing the same functions.

Although the invention has been disclosed in terms of the preferred and alternative embodiments disclosed herein, those skilled in the art will appreciate possible alternative embodiments and other modifications to the teachings disclosed herein which do not depart from the spirit and scope of the invention. All such alternative embodiments and other modifications and are intended to be included within the scope of the claims appended hereto.

What is claimed is:

1. An incinerator apparatus to burn at least confidential documents, comprising:

a room comprised of at least one wall which may be curved with a first end joined to a second end thereof to form a complete perimeter or at least three straight walls joined together to form a perimeter with the enclosed space inside said perimeter being for containing a fire and surfaces of said wall or walls enclosing said enclosed space being referred to herein as hot side(s) and opposite surfaces of said wall or walls being referred to as cold side(s);

a floor and a ceiling joined to said one or more walls to form and enclosed space;

a door or access port which can be closed and formed in at least one said wall, floor or ceiling;

a fireproof material lining the inner surfaces of said one or more walls, ceiling and floor and having sufficient insulating properties to prevent said one or more walls, floor and ceiling from igniting when a fire is lit in said room;

at least one reservoir of slow burning, flammable liquid;

at least one nozzle for spraying said slow burning, flammable liquid on confidential documents and other items stored in said room;

at least one valve means coupling said at least one reservoir to said at least one nozzle, said valve means for controlling fluid flow of said slow burning, flammable liquid to said nozzle;

at least one ignition means for generating sparks or open flame on a hot side of one of said walls, floor or ceiling so as to ignite material covered with said slow burning, flammable liquid;

an exhaust means for evacuation of combustion gases from said room after a fire is started therein;

control means coupled to said valve means, said ignition means and said exhaust means for controlling the sequence of events such that the contents of said room may be soaked with said slow burning, flammable liquid and then ignited and the exhaust evacuated.

2. The apparatus of claim 1 wherein said one or more walls, floor and ceiling are constructed of an aluminum frame and are lined with ceramic tile.

3. The apparatus of claim 2 wherein said ceramic tiles are glued to said aluminum frame with aluminum epoxy or silicone adhesive having sufficient heal resistance to withstand the temperatures at which documents and other materials in said room burn.

4. The apparatus of claim 1 wherein said reservoir is pressurized.

5. The apparatus of claim 1 wherein said reservoir is located on said cold side of said one or more walls.

6. The apparatus of claim 4 wherein said reservoir is located on said cold side of said one or more walls.

7. The apparatus of claim 4 wherein said at least one valve is a solenoid operated valve.

8. The apparatus of claim 1 wherein said one or more reservoirs are not pressurized, and wherein said control means includes one or more pumps coupled to said reservoir to pump flammable liquid through said nozzles during a portion of a control process wherein the contents of said room are soaked with said flammable liquid.

9. The apparatus of claim 1 wherein said one or more valves are solenoid operated valves and wherein said exhaust means is an electrically operated fan and chimney with electrically operated shutters, said fan coupled to suck combustion gasses out of said room and blow them up said chimney, and wherein said control means comprises:

a battery;

a start switch coupling said battery to a monostable multivibrator;

a relay having its control input coupled to the output of said monostable multivibrator and having a set of contact terminals for coupling said battery to said one or more solenoid operated valves;

a timer means having a control input coupled to said start switch and a battery input coupled to said battery, and having high power outputs coupled to said ignition means and said exhaust means, for receiving a signal when said start switch is pushed and starting a countdown timer to time out an interval during which spraying of said flammable liquid is occurring and including some interval after spraying is completed if necessary to allow vapors to settle out of the atmosphere sufficiently to make the atmosphere inside said room not explosive, and, when said interval has passed, for applying battery power through said high power outputs to said ignition means and said exhaust fan and said electrically operated shutters.

10. The apparatus of claim 1 wherein said exhaust means is a battery powered fan and chimney with electrically operated shutters or other security mechanisms to prevent unauthorized ingress to said room by a human through said chimney or by fiber optic spying equipment threaded down said chimney.

11. The apparatus of claim 1 wherein said room is built within a pre-existing room.

12. The apparatus of claim 1 wherein said room is built within a pre-existing room such that said one or more walls are parallel to the walls of the pre-existing room and said floor and ceiling are parallel to the floor and ceiling of said pre-existing room.

13. The apparatus of claim 1 wherein said one or more walls, said floor and said ceiling are constructed using aluminum frame members and wherein said fireproof material is ceramic tile attached to said aluminum frame members.

14. The apparatus of claim 13 wherein said ceramic tile has overlapping joints, with each tile glued to its neighboring tiles and to said aluminum frame members.

15. The apparatus of claim 1 wherein said nozzles are located at the top of said walls or in said ceiling.

16. The apparatus of claim 1 further comprising one or more file cabinets with one or more built in fans in the bottom thereof and having ventilation holes in at least the tops thereof.

17. The apparatus of claim 1 wherein said one or more fans are battery operated.

18. The apparatus of claim 9 wherein said fans are coupled to a high power output of said timer means so as to turn on at approximately the same time as said ignition means starts the fire.

19. The apparatus of claim 9 wherein said start switch is locked in a locked enclosure to which only trusted personnel have access.

* * * * *